US005671477A

United States Patent [19]

Aoki

[11] Patent Number: 5,671,477

[45] Date of Patent: Sep. 30, 1997

[54] BALL CATCHING GLOVE HAVING A PROJECTING PROTECTING UNIT

[75] Inventor: Akio Aoki, Osaka, Japan

[73] Assignee: Trion Corporation, Japan

[21] Appl. No.: 658,026

[22] Filed: Jun. 4, 1996

[30] Foreign Application Priority Data

Feb. 27, 1996 [JP] Japan ..... 8-039221

[51] Int. Cl.[6] ..... A63B 71/14; A41D 13/10

[52] U.S. Cl. ..... 2/19; 2/161.1; 2/162

[58] Field of Search ..... 2/16, 17, 19, 20, 2/21, 161.1, 163, 169, 162

[56] References Cited

U.S. PATENT DOCUMENTS

| | | | |
|---|---|---|---|
| 3,994,024 | 11/1976 | Bates | 2/19 |
| 4,065,813 | 1/1978 | Hudson | 2/19 |
| 4,541,127 | 9/1985 | Gould | 2/19 |
| 4,891,845 | 1/1990 | Hayes | 2/19 |
| 4,937,882 | 7/1990 | Hayes | 2/19 |
| 5,031,238 | 7/1991 | Hayes | 2/19 |
| 5,258,529 | 11/1993 | Arena | 2/19 |

*Primary Examiner*—C. D. Crowder
*Assistant Examiner*—Larry D. Worrell, Jr.
*Attorney, Agent, or Firm*—Webb Ziesenheim Bruening Logsdon Orkin & Hanson, P.C.

[57] ABSTRACT

A ball catching apparatus includes a first outer shell on the back side of a user's hand as inserted into the apparatus, a second outer shell on the ball catching side, and an inner shell disposed inwardly of the second outer shell. The apparatus further includes a protector unit attached to at least either the inner shell or the first outer shell for protecting the user's palm. The protector unit is attached in such a manner as to project from a finger inserting opening of the apparatus through which the user's thumb and fingers are inserted.

8 Claims, 5 Drawing Sheets

BALL CATCHING GLOVE HAVING A PROJECTING PROTECTING UNIT

BACKGROUND OF THE INVENTION

1. Field of the Invention

The present invention relates to a ball catching apparatus having a first outer shell on the back side of the user's hand, a second outer shell on the ball-catching side and an inner shell disposed inwardly of the second outer shell.

2. Description of the Related Art

With a ball catching apparatus of the above-noted type (such as a baseball catching apparatus), a core member made of e.g. felt material is interposed between the first outer shell on the ball catching side and the inner shell for the purpose of protecting the palm of the user.

However, such core material has a significant thickness and may impair the flexibility of the apparatus in the course of a ball catching action. Accordingly, this core member should be eliminated entirely if possible. Yet, without the core member, the apparatus could not provide appropriate palm protecting function. Further, it is desired that the protection be provided not only to the user's palm but also to as large as possible portion of the palm side area of the user's hand even including the wrist area.

Considering the above-described state of the art, a primary object of the present invention is to provide a ball catching apparatus having improved flexibility.

A further object of the invention is to provide a ball catching apparatus which has an improved flexibility, yet can provide protection over an extended palm side area of the user's hand including the wrist area thereof. This is because the wrist area should be protected against a possible accident of the ball hitting this area as a result of failure to catch the ball.

SUMMARY OF THE INVENTION

For fulfilling the above-noted objects, a ball catching apparatus, according to the present invention, comprises:

a first outer shell on the back side of a user's hand as inserted into the apparatus;

a second outer shell on the ball catching side:

an inner shell disposed inwardly of the second outer shell; and a protector unit attached to at least either said inner shell or said second outer shell for protecting the user's palm, the protector unit being attached in such a manner as to project from a finger inserting opening of the apparatus through which the user's thumb and fingers are inserted.

With the above construction, the protector unit is provided, instead of the core member, at the position of the apparatus where the core member used to be provided. With this, the flexibility of the apparatus has been improved. Further, as this protector unit is disposed in such a manner as to project from the finger inserting opening of the apparatus, the protector unit may protect a larger area of the user's palm. Hence, the wrist area may be properly protected when failure to catch the ball results in the accident of the ball hitting this wrist area. The protector unit may be attached to either the inner shell or the first outer shell (on the back side of the user's hand) alone. Alternatively, the unit may be attached to both of these shells. Still alternatively, as the inner shell is disposed inwardly of the second outer shell (on the ball catching side), the protector unit may be attached to both the inner shell and the second outer shell as well.

Moreover, if the protector unit is attached by using a lace provided originally for joining the first and second outer shells together, it becomes advantageously possible to eliminate any special connecting member for the protector unit alone.

Preferably, the apparatus further comprises a first shock absorbing member disposed at a position corresponding to the roots of the index or first finger and second finger, with the first shock absorbing member being attached to the inner shell by means of the protector unit. With this construction, there is obtained a further advantage of the protector unit being capable of protecting also the palm side areas of the first and second fingers.

Preferably, the apparatus further comprises a second shock absorbing member disposed at a portion of the protector unit projecting from the finger inserting opening. With this, the palm side area may be protected more reliably and extensively.

Preferably, the protector unit may be constituted from a first leather member and a second leather member sewn together by means of a thread. In this case, the protector unit may be attached to the inner shell by utilizing this thread, whereby the assembly of the apparatus may be facilitated. Further, in constituting the protector unit, the second shock absorbing member may be interposed between the first leather member and the second leather member.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of the present invention will be described in details with reference to FIGS. 1 through 6.

Figure 1:
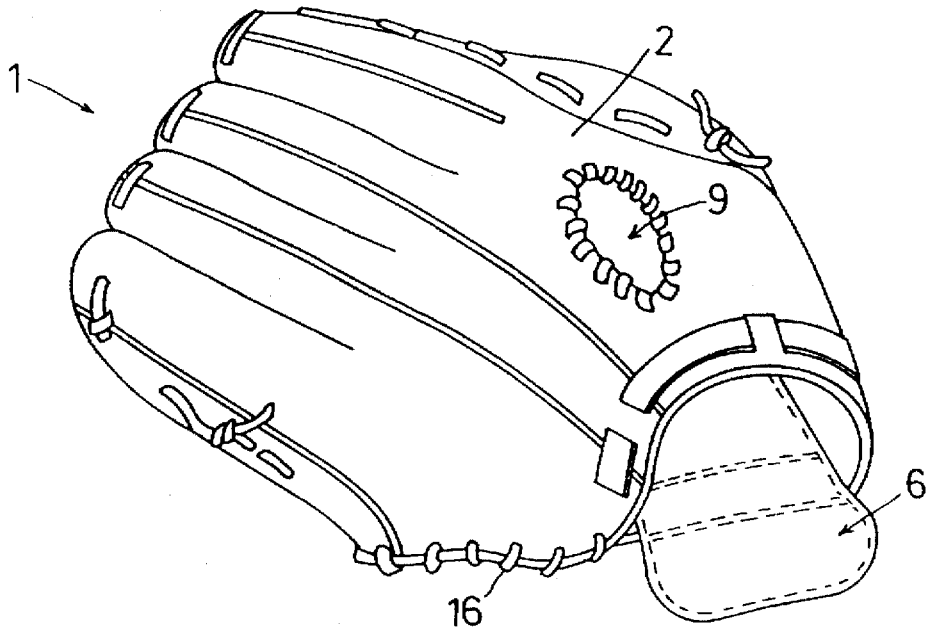
FIG. 1 shows an outer appearance of a baseball glove as viewed from the back side of the user's hand.
Figure 2:
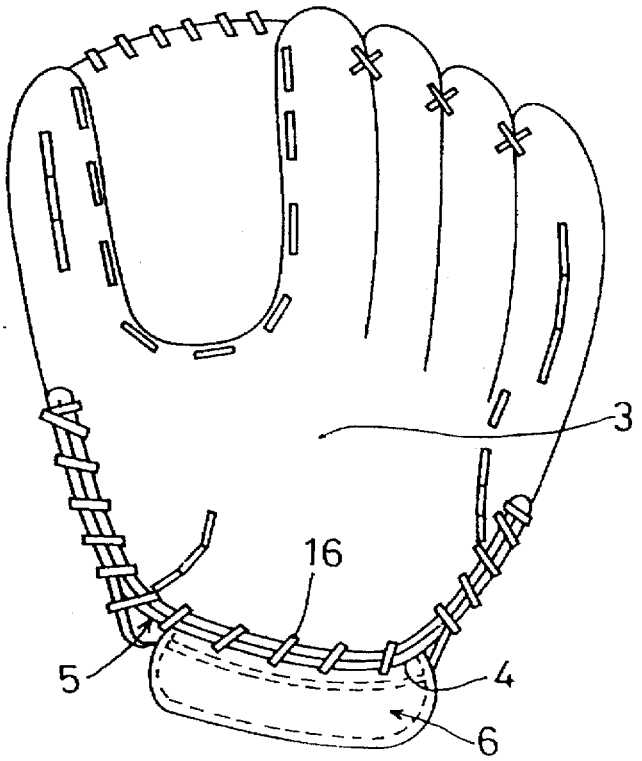
FIG. 2 shows the outer appearance of the baseball glove as viewed from the ball catching side.

FIG. 1 shows a baseball glove, as an example of a ball catching apparatus relating to this invention, as viewed from a back side of the user's hand when inserted into the glove. FIG. 2 shows the same glove as viewed from the ball catching side thereof. In this glove, a first outer shell 2 on the back side and a second outer shell 3 on the ball catching side are joined together by means of laces for example. Inwardly of the second outer shell 3, there is disposed an inner shell 4 which is joined to the second outer shell 3 by means of e.g. a lace 16. The glove has a finger inserting opening 5 for allowing insertion of the thumb and fingers of the user into the apparatus. The glove has also a protector unit 6 for protecting the palm side of the user's hand during a ball catching action. The glove defines a hole 9 for allowing projection therethrough of the first finger of the inserted user's hand to the outside of the glove.

Figure 3:
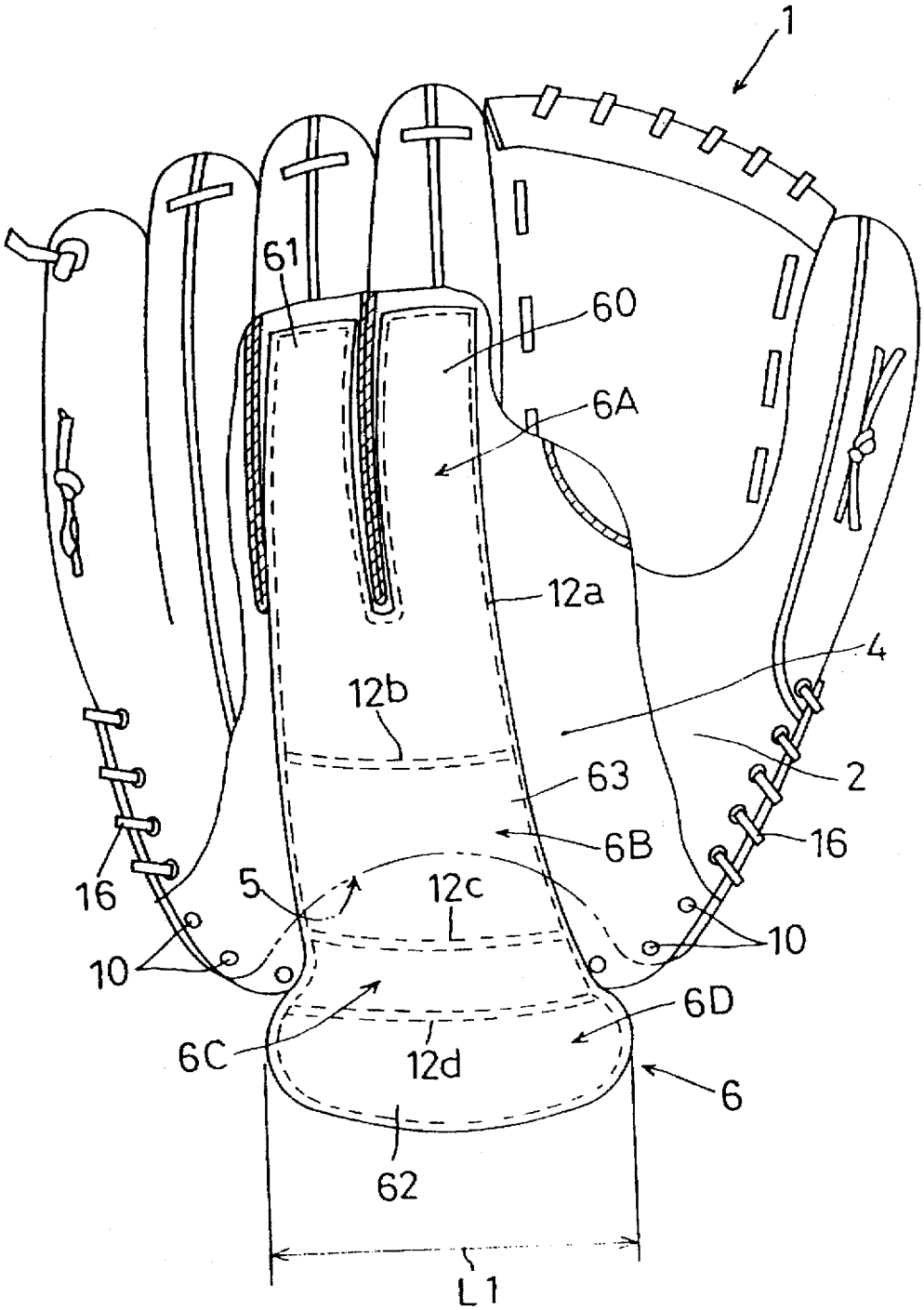
FIG. 3 shows an outer appearance of a protector unit.

The protector unit 6 will be described in details with reference to FIGS. 3 through 5. As shown in FIG. 3, the protector unit 6 includes, as major parts thereof, a first-finger root portion 60 for protecting the root area of the first finger, a second-finger root portion 61 for protecting the root area of the second finger, a projecting portion 62 projecting from the finger inserting opening 5, and a connecting portion 63 for connecting the first and second-finger root portions with the projecting portion. It is preferred that a width L1 of the protector unit 6 at the projecting portion 62 be as long as possible to be substantially equal to the width of the finger inserting opening 5.

Figure 4:
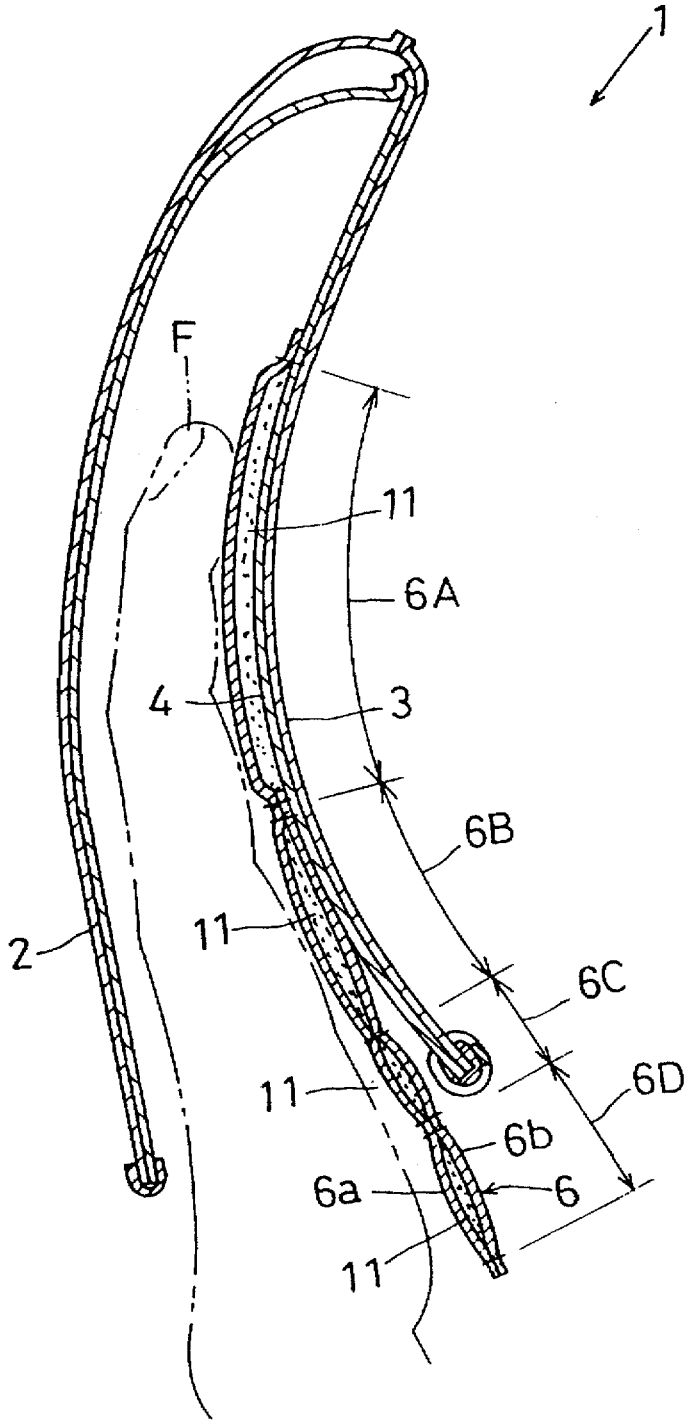
FIG. 4 is a section view of the protector unit.
Figure 5:
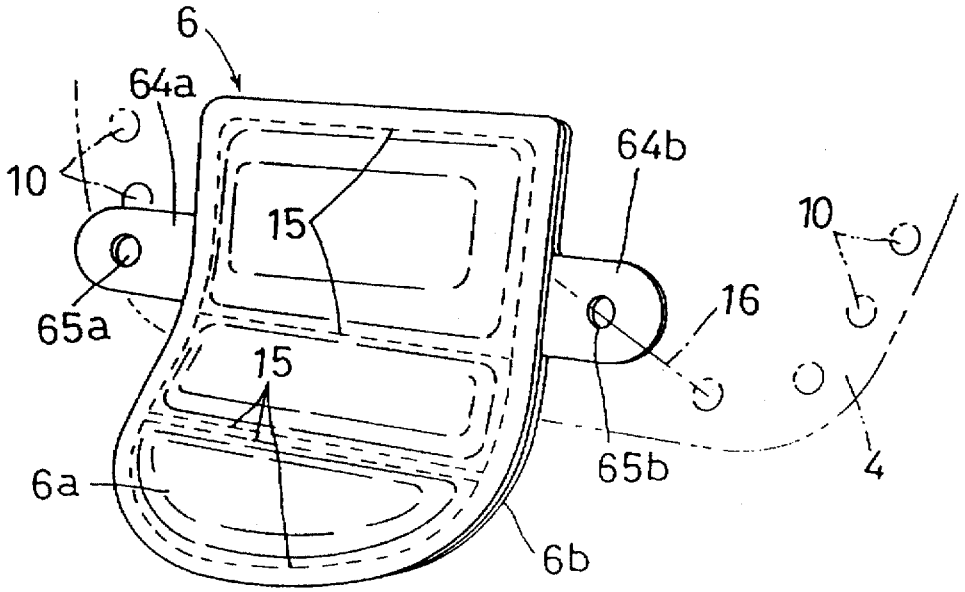
FIG. 5 shows a protector unit relating to a second embodiment.

As shown in FIG. 4, the protector unit 6 is comprised of a first leather member 6*a* disposed on the side to be touched by the fingers, a second leather member 6*b* interposed between the first leather member 6*a* and the inner shell 4 and of a shock absorbing member 11 made of sponge material. As to the material forming the shock absorbing member 11, the sponge material just mentioned is only one example, and this member 11 may be made of any other material such as alpha gel (α-GEL) material which is capable of effectively aborbing shock. Namely, this shock absorbing member 11 is provided for the purpose of absorbing the ball catching impact.

At an area 6A shown in FIGS. 3 and 4, the first leather member 6*a* is sewn to the inner shell 4 by means of threads 12*a*, 12*b*. And, at this area 6A, the shock absorbing member 11 is interposed between the first leather member 6*a* and the inner shell 4. At a further area 6B, the first leather member 6*a* and the second leather member 6*b* are sewn together by means of the threads 12*a*, 12*b* and 12*c* and the shock absorbing member 11 is interposed between the first leather member 6*a* and the second leather member 6*b*. Similarly, at still further areas 6C, 6D too, the first and second leather members 6*a*, 6*b* are sewn together by means of the threads 12*a*, 12*c* and 12*d*. The shock absorbing member 11 is provided as one continuous member extending through the plural areas. As may be seen in FIG. 3, a plurality of holes 10 are provided for allowing joining of the first outer shell 2 and the inner shell 4 by means of a lace 16.

FIG. 4 shows a condition in which user's fingers (only one is shown) are inserted. Because of absence of any core member made of e.g. felt between the second outer shell 3 and the inner shell 4, the flexibility of the glove is improved, so that the user can readily flex his/her fingers at the time of a ball catching action. Incidentally, although no core member is provided at the position where the protector unit 6 is disposed, a core member(s) will of course be provided at such positions (e.g. the position where the thumb is inserted) where the presence of core member(s) does not adversely affect the flexibility of the glove.

Further, as may be seen from FIG. 4, at the areas 6B, 6C and 6D, no connection is made to the inner shell 4. Accordingly, these areas, when actuated, may more flexibly follow the finger movement during e.g. a ball catching action, so that the presence of the areas 6C, 6D projecting from the finger inserting opening 5 will not deteriorate the total convenience of the glove.

Figure 6:
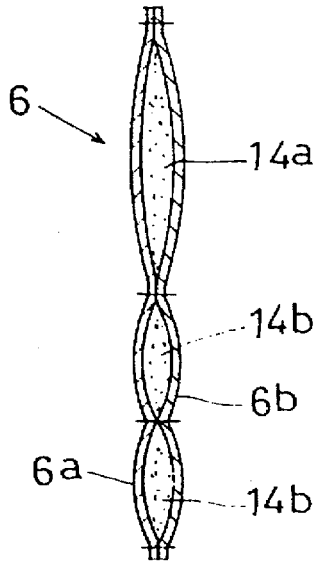
FIG. 6 is a section view of the protector unit relating to the second embodiment.

Next, a second embodiment of the protector unit 6 according to this invention will be described with reference to FIGS. 5 and 6. This protector unit 6, due to lack of the first and second-finger root portions, is formed more compact than the protector unit of the foregoing embodiment. The protector unit 6 of the instant embodiment includes a first leather member 6*a* and a second leather member 6*b* sewn together by means of threads 15 with shock absorbing members 14*a*, 14*b* being interposed between the two leather members 6*a*, 6*b*. The shock absorbing member 14*b* is provided as one continuous member. The second leather member 6*b* includes a pair of ear portions 64*a*, 64*b* which respectively define holes 65*a*, 65*b*. Then, by inserting the lace 16 shown in FIG. 2 through these holes 65*a* and 65*b*, the protector unit may be attached to the second outer shell 3 and to the inner shell 4.

In the instant embodiment, the ear portions 64*a*, 64*b* are formed by the second leather member Instead, these ear portions may be formed by the first leather member 6*a*. Further alternatively, with eliminating the ear portions 64*a*, 64*b*, the protector member may be directly sewn to the inner shell 4 by utilizing the threads 15.

Figure 7:
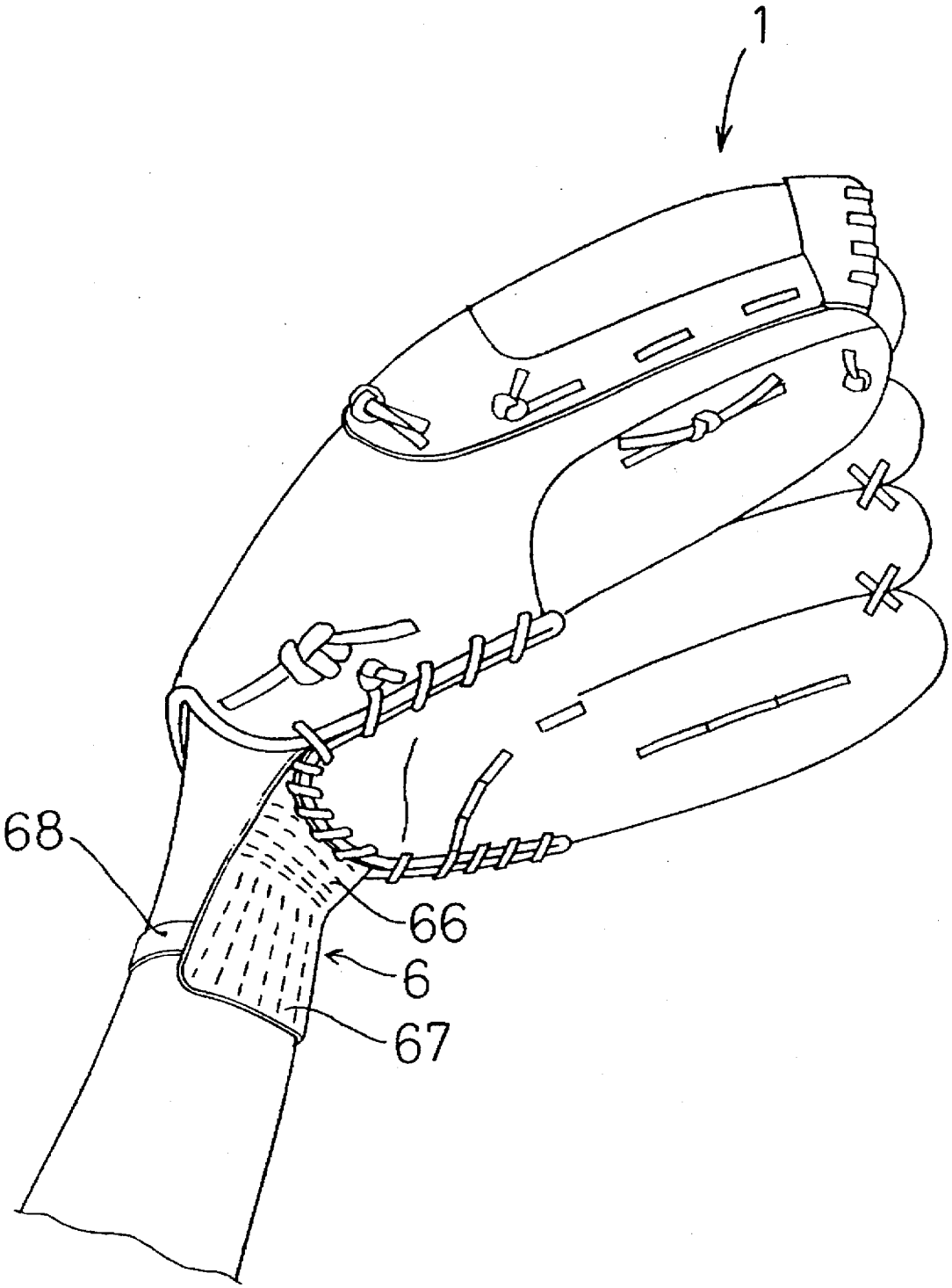
FIG. 7 is a view showing a protector unit relating to a third embodiment.

A third embodiment of the invention will be described with reference to FIG. 7.

In this embodiment, the protector unit 6 is further extended along the wrist area of the user and this unit 6 includes an area 66 having flexibility in the direction traverse to the longitudinal direction of the user's arm, a further area 67 having flexibility in the direction parallel to the longitudinal direction of the arm and a band 68 to be wound about the user's wrist to be detachably secured to the area 67 by means of e.g. a Velcro tape (registered trademark).

The foregoing embodiment relates to a glove. Yet, the present invention may also be embodied as a baseball mitt (first baseman's mitt or catcher's mitt) or any other ball catching apparatuses.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A ball catching glove, comprising:

a first outer shell;

a second outer shell;

a finger opening located between said first and second outer shells;

an inner shell disposed inwardly of the second outer shell;

a protector unit attached to at least one of said inner shell and said second outer shell for protecting a user's palm, wherein a portion of said protector unit projects from said finger opening; and a first shock absorbing member, with said first shock absorbing member located between said inner shell and said protector unit.

2. A glove as claimed in claim 1, wherein said protector unit is attached to said glove by a lace joining said first and second outer shells together.

3. A glove as claimed in claim 1, wherein said protector unit comprises a first leather member and a second leather member sewn together by thread.

4. A glove as claimed in claim 3, wherein said protector unit is attached to said inner shell by thread.

5. A ball catching glove, comprising:

a first outer shell;

a second outer shell;

a finger opening located between said first and second outer shells;

an inner shell disposed inwardly of the second outer shell; and a protector unit attached to at least one of said inner shell and said second outer shell for protecting a user's palm, wherein a portion of said protector unit projects from said finger opening and wherein said protector unit is attached to said glove by a lace joining said first and second outer shells together; and a first shock absorbing member disposed adjacent said inner shell, with said first shock absorbing member located between said inner shell and said protector unit.

6. A glove as claimed in claim 5, further comprising a second shock absorbing member disposed along said portion of said protector unit projecting from said finger opening.

7. A glove as claimed in claim 1, further comprising a second shock absorbing member disposed along said portion of said protector unit projecting from said finger opening.

8. A glove as claimed in claim 1, wherein said protector unit includes a band configured to be wound about a user's wrist.

* * * * *